United States Patent [19]

Pilat et al.

[11] Patent Number: 4,950,389

[45] Date of Patent: Aug. 21, 1990

[54] GRAVITY CONCENTRATOR

[76] Inventors: Boris V. Pilat, I mikroraion 21-a, kv. 63; Alexandr I. Yakunin, Anosova,47,kv. 20; Edil K. Galimzhanov, Dekarta, 37, kv. 46, all of Alma-Ata, U.S.S.R.

[21] Appl. No.: 337,043

[22] Filed: Apr. 12, 1989

[30] Foreign Application Priority Data

Apr. 14, 1988 [SU] U.S.S.R. ..... 4409818[I]

[51] Int. Cl.[5] ..... B03B 5/66

[52] U.S. Cl. ..... 209/157; 209/210

[58] Field of Search ..... 209/18, 132, 155, 157-159, 209/172, 173, 208, 210, 211

[56] References Cited

U.S. PATENT DOCUMENTS

| | | | |
|---|---|---|---|
| 2,700,468 | 1/1955 | Fontein | 209/211 |
| 2,946,439 | 7/1960 | Condolios et al. | 209/157 |
| 3,415,373 | 12/1968 | Pink et al. | 209/210 X |
| 4,043,760 | 8/1977 | Hiatt | 209/173 X |

FOREIGN PATENT DOCUMENTS

| | | | |
|---|---|---|---|
| 0722497 | 7/1942 | Fed. Rep. of Germany | 209/155 |
| 0581991 | 11/1977 | U.S.S.R. | 209/157 |
| 0451942 | 8/1936 | United Kingdom | 209/159 |
| 0603215 | 6/1948 | United Kingdom | 209/155 |

*Primary Examiner*—Johnny D. Cherry
*Assistant Examiner*—Edward M. Wacyra
*Attorney, Agent, or Firm*—Burgess, Ryan & Wayne

[57] ABSTRACT

A gravity concentrator has a casing provided with at least one diaphragm connected to a drive for initiating pulsations in the casing which has pipes for supplying a material being treated and separating fluid and pipes for discharging heavy and light fractions of the material being treated.

4 Claims, 3 Drawing Sheets

GRAVITY CONCENTRATOR

FIELD OF THE ART

The invention relates to the field of separation of solids using a liquid, in particular, water, and more specifically, it deals with gravity concentrators.

FIELD OF USE

The invention may be used for the separation of particles of different density or size in the mining, chemical and petroleum industries where it is necessary to separate particles by fractions, especially in dealing with fine particles.

The problem of exhaustion of ore deposits and placers calls for the beginning of processing of evergrowing volumes of ores with the aim of coping with the demand of mankind in metals, especially heavy metal such as gold, platinum, tungsten, lead and tin.

Stringent ecological requirements and evergrowing energy cost allow primary methods of concentration of mineral raw materials to be distinctly differentiated. The gravity methods of concentration are best to none in this respect.

Jigging machines, concentrator tables and auger locks are most widely used among known gravity concentrators. All these apparatuses are rather unproductive, and the first two apparatuses consume much water and electric energy.

Therefore, there is a problem of providing radically new gravity concentrators ensuring minimized water and electric energy consumption with a high degree of separation of mineral particles.

Operation of the majority of commercially available apparatuses is based on the difference between velocities of movement of particles of the material being treated of different mass in a liquid, e.g. in the water. The material being treated is subjected to various perturbances, e.g. pulsations in the vertical plane.

Such pulsations imparted to a continuous flow of the material being treated are applied locally within a short portion and allow heavy particles (coarse particles of gold, platinum, bismuth, tungsten and tin minerals) to be successfully separated into heavy fraction. However fine particles within the range from 5 to 500 μm, including finest particles (5–40 μm) cannot be concentrated with heavy fraction and are removed from the apparatus together with light fraction. Concentration of fine particles cannot be ensured in the conventional concentrators altogether.

BACKGROUND OF THE INVENTION

Known in the art is a gravity concentrator (U.S. Pat. No. A. 4,157,951) comprising a hollow casing which extends vertically and has a pipe for the admission of a separating fluid provided at the bottom end of the casing, a pipe for discharging the separating fluid and light fraction provided at the top end of the casing, and a pipe for discharging heavy fraction provided at the bottom end of the casing.

A material being treated is loaded into the gravity concentrator together with the separating fluid. An upward flow of the material being treated moving from the pipe for the admission of the separating fluid towards the pipe for discharging light fraction is created in the casing owing to the supply of the separating fluid. The light fraction is moved upwards by the flow of the material being treated and is discharged through the pipe for discharging light fraction, and heavy fraction with a higher specific gravity is concentrated in the bottom part of the casing and is discharged through the pipe for discharging heavy fraction.

The prior art concentrator is suitable for the separation of a classified material being concentrated. Only a laminary upward flow of the material being treated is created in the casing of the gravity concentrator so that a part of heavy fraction cannot be suspended. The possibility of obtaining high-grade concentrate is thus lowered. The effect of friction between particles of the material being treated and the inner surface of the casing is not used in the prior art gravity concentrator, and fine particles of heavy fraction are lost from the gravity concentrator with the upward flow of the material being treated.

The prior art gravity concentrator does not have any provision for imparting additional pulsations to the separating fluid and material being treated under restricted conditions so that efficiency of separation of the material being concentrated is low.

Also known in the art is a gravity concentrator (GB, A, 2,003,756) comprising a hollow cylindrical casing extending in an inclined position and having a partition dividing the casing into two conjugated chambers communicating with each other through a pipe provided in the partition and extending coaxially with the longitudinal axis of the casing. The top end of the casing has a pipe for supplying a material being treated, and the bottom end of the casing has a pipe for discharging heavy fraction.

The whole body of material being treated in the prior art gravity concentrator is suspended in a steady turbulent flow so that high-grade separation of heavy and light fraction particles cannot be ensured.

The prior art gravity concentrator cannot ensure pulsations of the separating fluid and material being treated under confined conditions so that efficiency of separation of the material being concentrated is low.

Known in the art is a gravity concentrator GB, A, No. 2,164,589) comprising a hollow casing extending in an inclined position for receiving a material being treated and having a pipe for supplying the material being treated, a pipe for supplying a separating fluid, and pipes for discharging light and heavy fractions of the material being treated.

The prior art gravity concentrator provides for the creation of a number of successive turbulent zones in which separation of heavy and light fractions occur. Fine particles of heavy fraction do not have time to move to the bottom of the gravity concentrator because of the steady turbulence and are lost with light fraction. The hydrodynamic conditions of separation of fractions of the material being concentrated cannot thus be optimized, namely, a pulsating flow of the material being treated with local turbulence under confined conditions cannot be created.

SUMMARY OF THE INVENTION

It is an object of the invention to enhance efficiency of separation of a material being treated into particles of heavy and light fractions which are preferably in the form of fine particles.

The object of the invention is accomplished by that a gravity concentrator comprises an elongated inclined casing for receiving a material being treated provided with a pipe for supplying the material being treated, a pipe for supplying a separating fluid, a pipe for discharging heavy fraction of the material being treated, a pipe for discharging light fraction of the material being treated. The gravity concentrator also comprises at least one drive for initiating pulsations in the casing which has at least one diaphragm connected to said drive for initiating pulsations in the casing.

Novelty features consist in the provision of at least one drive for initiating pulsations in the casing having at least one diaphragm connected to said drive for initiating pulsations in the casing.

The employment of the gravity concentrator according to the invention makes it possible to provide a compact modular plant for continuously concentrating fine particles of a size from 5 to 500 μm, the density of the material being treated widely ranging from 2 to 60. The degree of particle concentration in a single gravity concentrator may be as high as 60. No pollution of the environment occurs during operation of this gravity concentrator. The gravity concentrator features low consumption of water that can be reused. The gravity concentrator does not consume electric energy, or its consumption is minimized. The necessary pressure for supplying the material being treated to the casing of the gravity concentrator ranges from $1 \cdot 10^4$ to $3 \cdot 10^4$ Pa.

BRIEF DESCRIPTION OF THE DRAWINGS

The invention will now be described with reference to specific embodiments illustrated in the accompanying drawings, in which.

DETAILED DESCRIPTION OF THE INVENTION

Figure 1:
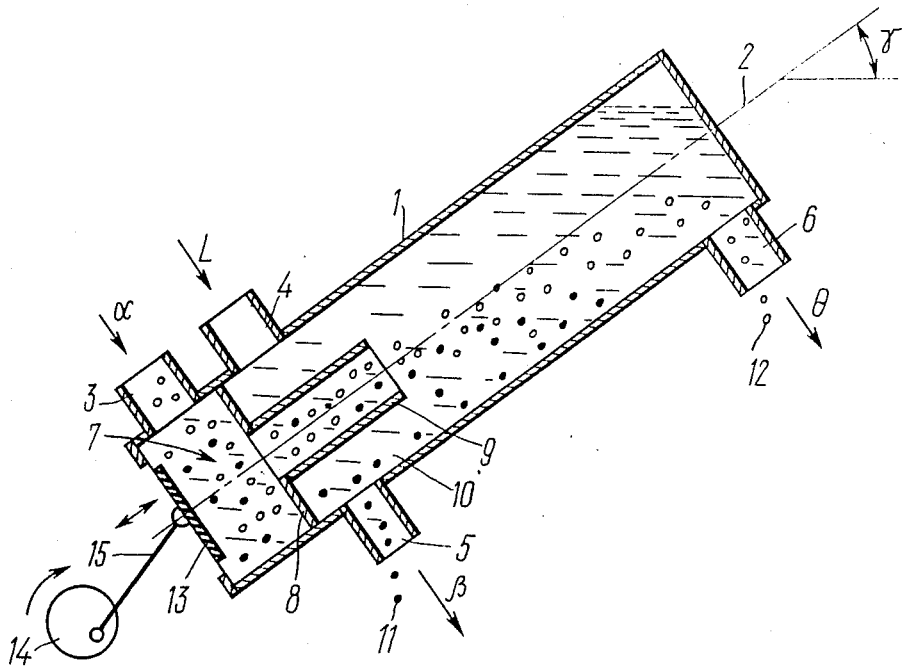
FIG. 1 is a general view of a gravity concentrator according to the invention having a diaphragm provided on the bottom end of the casing in longitudinal section.

A gravity concentrator comprises a hollow casing 1 (FIG. 1) of an elongated configuration having a longitudinal axis 2 which extends in an inclined position at an angle $\gamma$ with respect to a horizontal plane. The value of angle $\gamma$ ranges from 30° to 60°. The casing 1 has a pipe 3 for supplying a material being treated provided in the bottom part of the casing 1, a pipe 4 for supplying a separating fluid, and a pipe 5 for discharging heavy fraction.

The gravity concentrator also has a pipe 6 for discharging light fraction provided adjacent to the top end of the casing 1.

A material 7 being treated is supplied through the pipe 3 as shown by arrow $\alpha$.

A partition 8 is provided between the pipes 3 and 4 in the casing 1 and has a pipe 9 for admitting the material 7 to the interior of the casing. A space 10 is defined between the outer periphery of the pipe 9 and inner surface of the casing 1.

A separating fluid is supplied through the pipe 4 into the space 10 as shown by arrow L. Heavy fraction 11 is removed through the pipe 5 as shown by arrow $\beta$. Light fraction 12 is removed through the pipe 6 as shown by arrow $\theta$.

A diaphragm 13 is provided on the bottom end of the casing 1 and is connected to a drive 14 by means of a connecting member 15 for imparting longitudinal pulsations to the material being treated.

Figure 2:
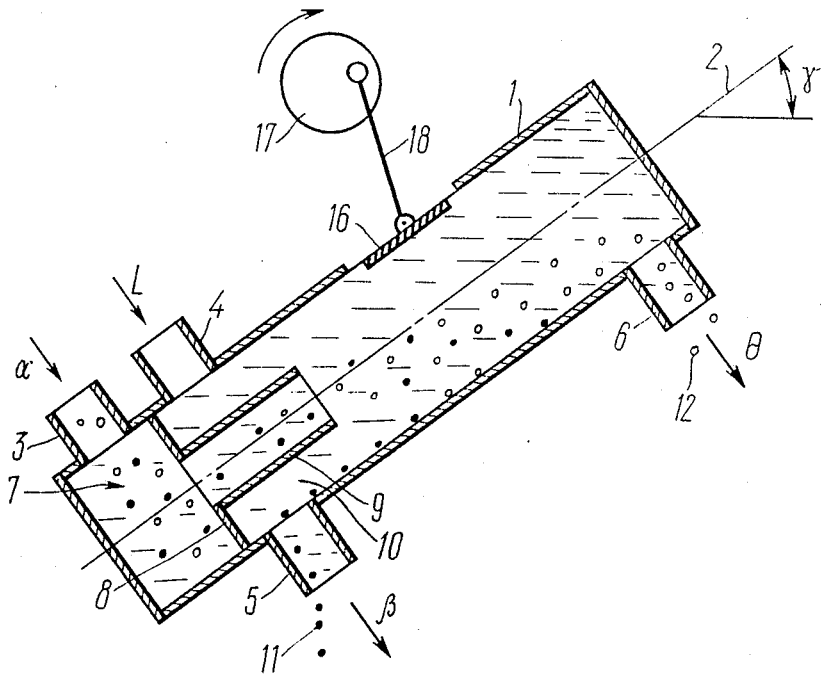
FIG. 2 is a general view of a gravity concentrator according to the invention having a diaphragm provided on the casing in longitudinal section.

A diaphragm 16 (FIG. 2) is provided on the periphery of the casing 1 and is connected to a drive 17 by means of a connecting member 18 for imparting transverse pulsations to the material being treated.

Figure 3:
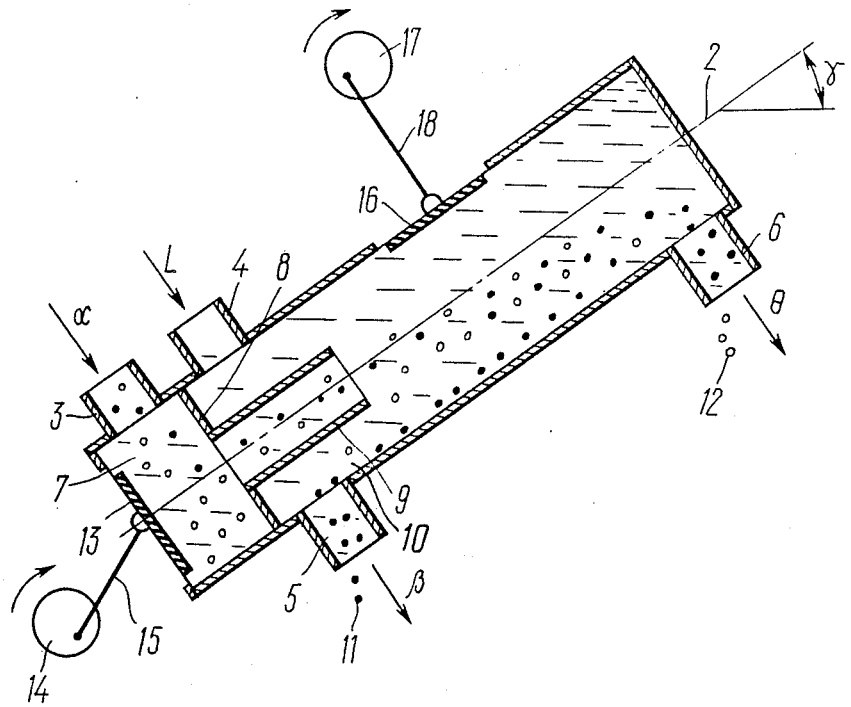
FIG. 3 is a general view of a gravity concentrator according to the invention having diaphragms provided on the bottom end and periphery of the casing in longitudinal section.

For simultaneously imparting transverse and longitudinal pulsations to the material 7 being treated, the diaphragm 13 is provided on the bottom end of the casing 1 and the diaphragm 16 is provided on the periphery of the casing 1 (FIG. 3).

The gravity concentrator functions in the following manner.

The material 7 being treated (FIG. 1) which is in the form of a mixture of particles of a mineral and liquid is supplied through the pipe 3 for supplying the material being treated and pipe 9 into the interior of the casing 1. A separating fluid, e.g. water is supplied through the pipe 4 into the space 10 and is mixed with the material 7 being treated. Turbulent vortices are thus formed in the flow of the material 7 being treated because of non-uniformity of properties of the material at the moment it is mixed with water. Owing to the turbulent vortices, the resultant mixture is suspended, and particles are separated within the body of the material 7 being treated. The precipitating grains forming the heavy fraction 11 are removed through the pipe 5 using a part of the liquid admitted to the casing 1 of the gravity concentrator through the pipe 4 as carrier flow. Light particles of the material 7 being treated, i.e. the light fraction 12 entrained with the flow of the material 7 being treated that moves up along the inclined casing 1 under confined conditions are removed through the pipe 6 for discharging the light fraction 12. During movement of the material 7 being treated along the inclined casing 1 the material 7 being treated is separated into fractions under the action of gravity, friction forces, buoyancy and forces of resistance to movement of mineral particles in the material being treated cause by viscosity of the material being treated. The heaviest particles 11 of the material 7 being treated getting into The wall boundary layer under gravity move in opposition to the flow of the material 7 being treated in the casing 1. The formation of the wall boundary layer is caused by friction between the flow of the material 7 being treated and the inner surface of the casing 1. The presence of a local turbulence caused by the inner surface of the casing 1 and outer periphery of the pipe 9 contributes to the cleaning of the heavy particles 11 moving within the wall boundary layer. When the heavy particles 11 get into the space 10 where they are mixed with the flow of the separating fluid, the particles 11 are additionally cleaning owing to the local turbulence caused by non-uniformity of properties of the material being treated at the moment it is mixed with water.

The provision of the longitudinal or transverse pulsations or both created by the diaphragms 13 or 16 (FIG. 2) or both the diaphragms 13 and 16 (FIG. 3) contributes to the isolation of the heavy particles 11 from the material 7 being treated and their cleaning from the sticking light particles 12. The local turbulence of the flow of the material 7 being treated causes reorientation of the moving particles 11, 12 in the material 7 being treated, and centripetal accelerations occur which contribute to a preliminary separation of the particles 11, 12. The final separation of the particles 11, 12 in accordance with density and size occurs in a transition area which forms in the body of the moving material 7 being treated under laminary, turbulent and transitional flow conditions.

Therefore, the gravity concentrator according to the invention makes it possible to optimize hydrodynamic conditions of separation of fractions of the material being concentrated owing to the provision of pulsations in the flow of the material 7 being treated with a local turbulence gradually turning to laminary flow which is accompanied by the wall boundray effect. This provides conditions for efficient separation of heavy and light particles of minerals.

The provision of the diaphragm 13 (FIG. 1) on the bottom end of the casing 1 contributes to the creation of longitudinal pulsations imparted in the direction of flow of the material 7 being treated along the axis 2 of the casing 1. This results in local turbulence zones being formed along the whole extent of the flow of the material 7 being treated and separating fluid within the casing 1. The creation of the local turbulence zone is caused by inertia forces owing to a change in velocities of particles of the material 7 being treated caused by the longitudinal pulsations. Particles of the light fraction 12 which have a lower inertia are given substantial amounts of displacement with respect to the flow of the separating fluid so that these particles cannot move into the wall boundary layer thus enhancing separation of the material 7 being treated.

Particles of heavy fraction having a greater inertia move within the wall boundary layer towards the pipe 5 under gravity. The longitudinal pulsations contribute to lowering of friction forces acting upon these particles and to their unobstructed discharge through the pipe 5.

The provision of the diaphragm 16 (FIG. 2) on the periphery of the casing 1 contributes to the creation of the transverse pulsations. Particles of the light fraction 12 are suspended, they do not move into the wall boundary layer and are easily removed from the casing 1 through the pipe 6 together with the separating fluid.

Particles of the heavy fraction 11 do not leave the wall boundary layer zone under the action of the transverse pulsations owing to their inertia and are discharged through the pipe 5 from the casing 1.

The combined use of both longitudinal and transverse pulsations contributed to the provision of an integrated effect of separation of the material 7 being treated into the light fraction 12 and heavy fraction.

Therefore efficiency of separation of the material being treated, preferably of fine particles, is enhanced in the gravity separator according to the invention owing to the provision of the pulsation conditions of separation under confined conditions during the entire period of residence of the flow of the material being treated 7 and separating fluid in the casing 1.

We claim:

1. A gravity concentrator comprising:

an inclined elongated hollow casing for receiving a material being treated, a bottom end and periphery of said casing;

a pipe of said inclined casing for supplying a separating fluid;

a pipe of said inclined casing for supplying a material being treated;

a pipe of said inclined casing for discharging heavy fraction of the material being treated;

a pipe of said inclined casing for discharging light fraction of the material being treated;

at least one diaphragm of said casing designed for imparting pulsations to said material being treated and separating fluid within said casing;

at least one drive for initiating pulsations in said casing connected to said diaphragm and designed for imparting reciprocations to said diaphragm.

2. A gravity concentrator according to claim 1, comprising:

said at least one diaphragm provided on said bottom end of said casing.

3. A gravity concentrator according to claim 1, comprising:

said at least one diaphragm provided on said periphery of said casing.

4. A gravity concentrator according to claim 1, comprising:

a first diaphragm and a second diaphragm for imparting longitudinal and transverse pulsations in the casing with respect to the direction of flow of the material being treated and separating fluid;

a first drive and a second drive for initiating pulsations in said casing;

said first diaphragm being provided on said bottom end of said casing and connected to said first drive for initiating pulsations in said casing;

said second diaphragm being provided on said periphery of said casing and connected to said second drive for initiating pulsations in said casing.

* * * * *